US010226940B2

(12) United States Patent
Olsen et al.

(10) Patent No.: US 10,226,940 B2
(45) Date of Patent: Mar. 12, 2019

(54) PRINTER FLUID CIRCULATION SYSTEM INCLUDING AN AIR ISOLATION CHAMBER AND A PRINTER FLUID PRESSURE CONTROL VALVE

(71) Applicant: HEWLETT PACKARD DEVELOPMENT COMPANY, L.P., Houston, TX (US)

(72) Inventors: David Olsen, Corvallis, OR (US); Mark A Devries, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/504,013

(22) PCT Filed: Aug. 14, 2014

(86) PCT No.: PCT/US2014/050992
§ 371 (c)(1),
(2) Date: Feb. 14, 2017

(87) PCT Pub. No.: WO2016/024973
PCT Pub. Date: Feb. 18, 2016

(65) Prior Publication Data

US 2017/0259580 A1 Sep. 14, 2017

(51) Int. Cl.
*B41J 2/19* (2006.01)
*B41J 2/175* (2006.01)
(Continued)

(52) U.S. Cl.
CPC ..... *B41J 2/19* (2013.01); *B41J 2/175* (2013.01); *B41J 2/17596* (2013.01); *B41J 2/18* (2013.01); *B41J 29/13* (2013.01); *B41J 2202/12* (2013.01)

(58) Field of Classification Search
CPC ... B41J 2/19; B41J 2/18; B41J 2/17596; B41J 29/13; B41J 2/175; B41J 2202/12
See application file for complete search history.

(56) References Cited

U.S. PATENT DOCUMENTS 7,845,784 B2 12/2010 Nitta et al.
8,459,785 B2 6/2013 Morgan et al.
(Continued)

FOREIGN PATENT DOCUMENTS

CN 1927590 3/2007
CN 1974225 6/2007
(Continued)

OTHER PUBLICATIONS

International Searching Authority. ISA/KR. International Search Report. Dated May 12, 2015. Application No. PCT/US2014/050992. Filing date Aug. 14, 2014.
(Continued)

*Primary Examiner* — Yaovi M Ameh
(74) *Attorney, Agent, or Firm* — HP Inc. Patent Department

(57) ABSTRACT

Systems and related methods are described for circulating and printing fluid onto a printer media. In one example, a system can include an air isolation chamber to pool printing fluid circulated within the system. The air isolation chamber can be fluidly connected to a printhead assembly to eject a portion of the printing fluid onto the printer media. The system can further include a pump to pump printing fluid from the air isolation chamber to the printhead assembly. The system can further include a pressure control valve along a return line between the air isolation chamber and the printhead assembly to regulate the flow of unejected printing fluid to the air isolation chamber to control printing fluid pressure over the printhead assembly.

14 Claims, 6 Drawing Sheets

(51) Int. Cl.
*B41J 2/18* (2006.01)
*B41J 29/13* (2006.01)

(56) References Cited

U.S. PATENT DOCUMENTS

| | | | | |
|---|---|---|---|---|
| 8,480,211 | B2 | 7/2013 | Rosati et al. | |
| 8,657,420 | B2 | 2/2014 | Holsington et al. | |
| 2006/0244790 | A1* | 11/2006 | Umeda | B41J 2/17509 347/84 |
| 2007/0052779 | A1 | 3/2007 | Cho | |
| 2007/0120912 | A1* | 5/2007 | Lim | B41J 2/1707 347/92 |
| 2007/0263244 | A1* | 11/2007 | Sugitani | B41J 3/543 358/1.15 |
| 2008/0055378 | A1* | 3/2008 | Drury | B41J 2/19 347/92 |
| 2011/0181670 | A1* | 7/2011 | Tsubaki | B41J 2/175 347/85 |
| 2013/0021416 | A1* | 1/2013 | Yokoyama | B41J 2/175 347/85 |
| 2013/0194361 | A1 | 8/2013 | Takahashi | |
| 2013/0248450 | A1 | 9/2013 | Kenley et al. | |
| 2014/0015905 | A1* | 1/2014 | Esdaile-Watts | B41J 2/18 347/89 |

FOREIGN PATENT DOCUMENTS

| | | |
|---|---|---|
| CN | 101100137 | 1/2008 |
| CN | 102189806 | 9/2011 |
| CN | 102630201 | 8/2012 |
| CN | 103945019 | 7/2014 |
| EP | 1905598 | 4/2008 |

OTHER PUBLICATIONS

Reinhold, I., Zapka, W., Voit, W., Steinhäußer, F., Stürmer, M., Madjarov, A., & Völker, M. (Jan. 2010). Inkjet Printing of Phase-Change Materials With Xaar1001 Printheads. In NIP & Digital Fabrication Conference (vol. 2010 No. 1 pp. 319 322) Society for Imaging.

* cited by examiner

PRINTER FLUID CIRCULATION SYSTEM INCLUDING AN AIR ISOLATION CHAMBER AND A PRINTER FLUID PRESSURE CONTROL VALVE

BACKGROUND

Inkjet printers can be used to print text, pictures, or other graphics by propelling droplets of liquid printing fluid onto a piece of printer paper or other media. Such printers will often include replaceable printer cartridges that house multiple printing fluid reservoirs which feed to corresponding cartridge printheads. The reservoirs will often contain different color printing fluids so as to allow the printer to print color graphics. For example, a printer cartridge can include a first reservoir that contains cyan printing fluid, a second reservoir that contains magenta printing fluid, a third reservoir that contains yellow printing fluid, and a fourth reservoir that contains black printing fluid.

BRIEF DESCRIPTION OF THE DRAWINGS

For a detailed description of various examples, reference will now be made to the accompanying drawings in which.

NOTATION AND NOMENCLATURE

Figure 1:
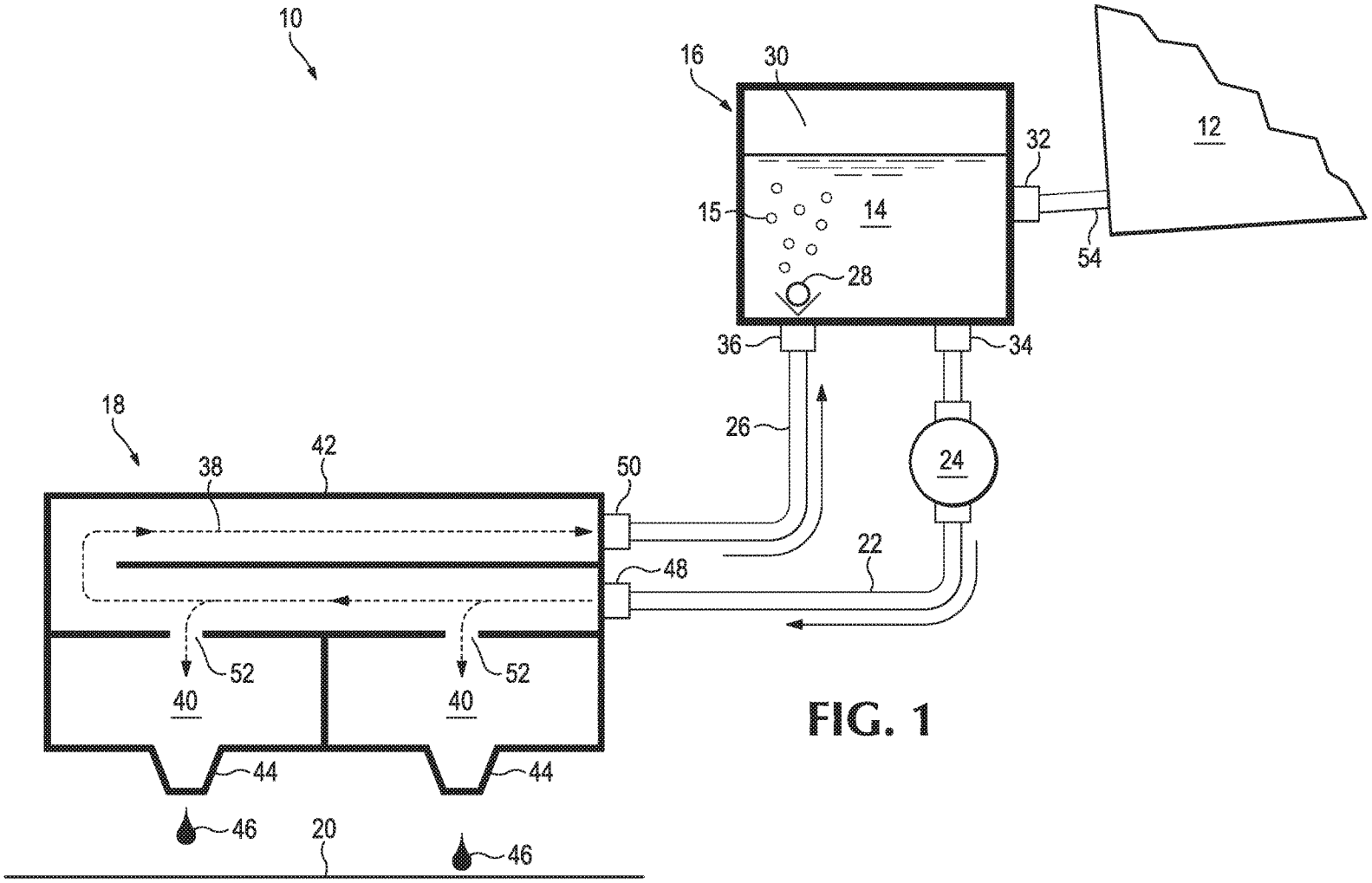
FIG. 1 is a diagram of a printing fluid circulation and printing system, according to an example.

In the following discussion and in the claims, the terms "including" and "comprising" are used in an open-ended fashion, and thus should be interpreted to mean "including, but not limited to . . . ." The term "approximately" as used herein to modify a value is intended to be determined based on the understanding of one of ordinary skill in the art, and can, for example, mean plus or minus 10% of that value.

DETAILED DESCRIPTION

The following discussion is directed to various examples of the disclosure. Although one or more of these examples may be preferred, the examples disclosed should not be interpreted, or otherwise used, as limiting the scope of the disclosure, including the claims. In addition, the following description has broad application, and the discussion of any example is meant only to be descriptive of that example, and not intended to intimate that the scope of the disclosure, including the claims, is limited to that example.

Printheads can provide improved printing performance when printing fluid is delivered to the printhead within a predetermined pressure range. However, variations in one or more components of the printing fluid delivery system, such as in the length and size of printing fluid tubing, manifolding, fluidic interconnects, and the like may cause the pressure delivered to the printheads to vary outside of this predetermined pressure range. In addition, air bubbles in the printing fluid can also cause variation in the delivered printing fluid pressure and can cause printhead failure if they are delivered to the printhead in large quantities.

Certain implementations of this disclosure are designed to address these issues by stabilizing and controlling the pressure of printing fluid delivered from a printing fluid supply across a range of fluidic architectures and flow rates while flushing air bubbles from the printing fluid channels and away from the printheads. In some implementations, a solution to these issues can include a printing fluid circulation and printing system that circulates printing fluid from a printing fluid chamber to one or more printhead devices and back to the printing fluid chamber through a pressure control valve. The pressure control valve can, for example, include a spring loaded variable orifice that opens in response to printing fluid flow and produces a pressure drop across the orifice. This pressure control valve can, for example be in the form of a ball spring loaded against a seat in some implementations, or a duckbill, or umbrella check valve with suitably stiff side walls to provide a desired pressure drop in other implementations. Running the pump during printing at a rate greater than the actual print rate can cause unejected printing fluid to flow through the pressure control valve, the pressure control valve being designed to produce a positive and controlled pressure in the printing fluid circuit to feed the printhead devices. The printing fluid chamber provides a place for isolating air bubbles from the printing fluid stream by allowing them to float out of the printing fluid and away from the printing fluid flow return inlet and supply outlet.

FIG. 1 illustrates a schematic of one example of a printing fluid circulation and printing system 10. In this implementation, system 10 includes a printing fluid reservoir 12 to hold a supply of printing fluid 14, an air isolation chamber 16 to pool printing fluid 14 to be circulated within system 10, a printhead assembly 18 to print a portion of printing fluid 14 onto a printer substrate 20, a supply line 22 to supply printing fluid 14 from air isolation chamber 16 to printhead assembly 18, a pump 24 along supply line 22 to pump printing fluid 14 from air isolation chamber 16 to printhead assembly 18, a return line 26 to return unejected printing fluid 14 from printhead assembly 18 to air isolation chamber 16, and a pressure control valve 28 along return line 26 to regulate the return flow of unejected printing fluid 14 to air isolation chamber 16 to control printing fluid pressure over the printhead assembly. Each of these components will be described in further detail below.

Printhead assembly 18 can, for example, be in the form of a fixed position print bar with a substrate-wide array of nozzles. In some implementations, a printer substrate, such as a piece of printer paper can be moved under the nozzles during printing. Printhead assembly 18 can be a scanning-type printhead that is designed to move side-to-side along a track relative to substrate 20 during printing. Printhead assembly 18 can be moved along the track by a motor or other actuator for positioning assembly 18 over a desired location of substrate 20. Printer substrate 20 can, for example, be alternatively or additionally moved to assist in positioning substrate 20 relative to printhead assembly 18. For example, in some printers, printhead assembly 18 is moved along a track to position itself at a desired width-wise position of substrate 20 and substrate 20 is fed into the printer so as to position substrate 20 at a desired length-wise position of printhead assembly 18. When printhead assembly 18 is located at the desired width and length location, printhead assembly 18 can be instructed to propel one or more droplets of printing fluid 14 onto substrate 20 in order to print a graphic onto substrate 20. Printhead assembly 18 and/or substrate 20 can then be moved to another position and printhead assembly 18 can be instructed to propel additional droplets of printing fluid 14 onto substrate 20 in order to continue printing the graphic onto substrate 20. In some implementations where printhead assemblies 18 are designed to be moved relative to substrate 20, other components of system 10 such as air isolation chamber 16 and printing fluid reservoir 12 can be designed to stay fixed in place.

Printing fluid reservoir 12 is designed to store a supply of printing fluid 14 for use in system 10. Printing fluid reservoir 12 can be in a form suitable for long-term storage, shipment, or other handling. Printing fluid reservoir 12 can, for example, be a rigid container with a fixed volume (e.g., a rigid housing), a deformable container (e.g., a deformable bag), or any other suitable container for the printing fluid supply. Printing fluid reservoir 12 can be stored within a housing of system 10. For example, in some implementations, a cover or housing panel of a printer can be removed to allow a user to access and/or replace printing fluid reservoir 12. In some implementations, printing fluid reservoir 12 can be located outside of a housing of system 10 and can, for example, be fluidly connected to system 10 via an intake port on an exterior surface of a housing of system 10.

Printing fluid 14 can be flowed from printing fluid reservoir 12 to air isolation chamber 16 via a pump, plunger, or another suitable actuator. For example, in implementations where printing fluid reservoir 12 is a flexible bag, an actuator can be used to compress printing fluid reservoir 12 to force printing fluid 14 out of printing fluid reservoir 12 and into air isolation chamber 16. In some implementations, printing fluid reservoir 12 can be positioned above air isolation chamber 16 so as to allow a gravitational force to assist in providing printing fluid 14 from printing fluid reservoir 12 to air isolation chamber 16. Although reference is made herein to printing fluid 14 being transferred from printing fluid reservoir 12 to air isolation chamber 16, it is appreciated that in some implementations, system 10 can be designed to flow printing fluid 14 from air isolation chamber 16 to printing fluid reservoir 12 for storage or another desired purpose.

Printing fluid 14 can be any suitable type for use in an inkjet printer. Inkjet printers are printers that eject printing fluids onto media from a plurality of nozzles on one or more printheads. The printheads can be thermal inkjet printhead, piezo electric printhead or the like. Printing fluid is any fluid deposited onto media to create an image, for example a pre-conditioner, gloss, a curing agent, colored inks, grey ink, black ink, metallic ink, optimizers and the like. Inkjet inks can be water based inks, latex inks or the like. For example, printing fluid 14 can be in the form of aqueous or solvent printing fluid. In some implementations, printing fluid 14 can, for example, have a viscosity of about 2.74 cP at 25 degrees Celsius so as to achieve desired flow properties within system 10. It is appreciated that a desired viscosity can vary based on the color, temperature, or other properties of printing fluid 14. Printing fluid 14 can be black, cyan, magenta, yellow, or any other suitable color for using in an inkjet printer. In some implementations, system 10 can include multiple printing fluid reservoirs 12, with each reservoir designed to contain a separate type or color of printing fluid. The separate types or colors of printing fluid can flow along separate routes so as not to mix within system 10. For example, as described below with respect to the system of FIG. 4, a printing fluid circulation and printing system can include separate printing fluid reservoirs 12, air isolation chambers 16, supply lines 22, return lines 26, and printhead assemblies 18 for use with different types or colors of printing fluid 14. However, in some implementations, separate types or colors of printing fluid 14 can be mixed within system 10 before being printed onto printer media 20. Although certain implementations of system 10 described herein are designed to remove air bubbles 15 from printing fluid 14, it is appreciated that previously de-gassed printing fluid 14 may also be used in system 10. Certain implementations of this disclosure can, for example, work well with saturated printing fluids, which can allow bubbles to grow more readily than degassed printing fluid.

As described above, air isolation chamber 16 can provide a place for isolating air bubbles 15 from the printing fluid stream by allowing the air bubbles to float out of printing fluid 14 and away from printing fluid flow return inlet 36 and supply outlet 34. For example, in some implementations, air isolation chamber 16 can be designed to be partially filled with printing fluid 14 so as to pool printing fluid 14 and provide an air pocket 30 to remove air bubbles 15 from printing fluid 14. Air isolation chamber 16 can be a rigid chamber with a fixed volume or a flexible chamber with a variable volume. Air isolation chamber 16 can be used to store a working amount of printing fluid 14 for circulation within system 10 during printing, whereas printing fluid reservoir 12 can be used to store a printing fluid supply that can be used to supplement the level of printing fluid 14 circulated within system 10. In some implementations, system 10 may not include a separate printing fluid reservoir coupled to air isolation chamber 16. Air isolation chamber 16 can include filters to filter printing fluid 14 or other devices for treating printing fluid 14 circulating through system 10.

Air isolation chamber 16 can include multiple inlets and outlets to fluidly connect to other components of system 10. For example, as shown in FIG. 1, air isolation chamber 16 can include a reservoir inlet 32 for connecting to printing fluid reservoir 12 via a reservoir line 54, a supply outlet 34 for connecting to printhead assembly 18 via supply line 22, and a return inlet 36 for connecting to printhead assembly 18 via return line 26. Although the terms "inlet" and "outlet" are used for ease of reference, it is appreciated that in some implementations, such ports can function as both an inlet and an outlet. For example, in some implementations, supply outlet 34 can be designed to receive returned printing fluid 14 from supply line 22. It is appreciated that additional inlets and outlets for air isolation chamber 16 can be provided.

As described above, printhead assembly 18 can be designed to print a portion of printing fluid 14 onto a printer media 20. In some implementations, printhead assembly 18 can accomplish this through the use of internally defined paths that route pressurized printing fluid 14 along a printing fluid route 38 through printhead assembly 18, with a portion of printing fluid 14 being ejected from printhead assembly 18 onto printer media 20 and the remaining printing fluid 14 being returned to air isolation chamber 16 via return line 26.

Printhead assembly 18 includes one or more printheads 40 to eject printing fluid 14 onto printer media 20 and a manifold 42 to receive printing fluid 14 from air isolation chamber 16, direct printing fluid 14 to the appropriate printhead 40, and to return unejected printing fluid 14 to air isolation chamber 16. It is appreciated that the term "print" is intended to include such techniques as ejecting, spraying, propelling, depositing, or other suitable techniques for printing fluid 14 onto printer media 20.

Each printhead 40 within printhead assembly 18 can be designed to print printing fluid 14 from a nozzle 44 onto printer media 20. Printheads 40 can, for example, be designed to print via a thermal inkjet process. For example, in certain thermal inkjet processes, printing fluid droplets 46 are ejected from printhead 40 via a pulse of current that is passed through a heater positioned in printhead 40. Heat from the heater causes a rapid vaporization of printing fluid 14 in the printhead to form a bubble, which causes a large pressure increase that propels a droplet of printing fluid 14 onto printer media 20. In some implementations, printheads 40 can be designed to print via a piezoelectric inkjet process. In certain piezoelectric inkjet processes, a voltage is applied to a piezoelectric material located in a printing fluid-filled chamber. When a voltage is applied, the piezoelectric material changes shape, which generates a pressure pulse that forces a droplet of printing fluid 46 from printhead 40 onto printer media 20.

Manifold 42 includes a supply inlet 48 to receive printing fluid 14 from supply line 22, a return outlet 50 to return unejected printing fluid 14 to return line 26, and channels 52 for each printhead 40 that divert a portion of printing fluid 14 to a respective printhead 40. In some implementations, printhead assembly 18 can, for example as depicted in FIG. 1, include distinct manifold 42 and printhead 40 units that are attached together. In some implementations, manifold 42 and printheads 40 are formed from a single monolithic piece of material.

Printhead assembly 18 can include pressure regulators that regulate the pressure of printing fluid 14 within printhead assembly 18. For example, such regulators can control the flow of printing fluid 14 to printheads 40. Printhead assembly 18 can additionally or alternatively include printing fluid flow diverters that control the flow of printing fluid 14 within printhead assembly 18. For example, when a pressure of printing fluid 14 within printheads 40 passes a threshold, a flow diverter can divert printing fluid flow such that printing fluid 14 is routed directly to return outlet 50 without passing to printheads 40.

Printer media 20 can be in the form of any media onto which system 10 is designed to print. For example, printer media 20 can be in the form of computer paper, photographic paper, a paper envelope, or similar paper media. Printer media 20 can be a standard rectangular paper size, such as letter, A4 or 11×17. It is appreciated, however, that printer media 20 can in some implementations be in the form of suitable non-rectangular and/or non-paper media, such as clothing, wood, or other suitable materials.

The implementation of system 10 in FIG. 1 includes pump 24 along supply line 22. Pump 24 is used to pump printing fluid 14 from air isolation chamber 16 to printhead assembly 18. In some implementations, pump 24 can be designed to pump printing fluid 14 from air isolation chamber 16 to printhead assembly 18 by deforming supply line 22. In some implementations, pump 24 can be in the form of a diaphragm pump that connects a first segment of supply line 22 to a second segment of supply line 22.

Pump 24 can be run at one or more predetermined speeds or conditions so as to achieve a desired pressure over pressure control valve 28. For example, through the use of one or more pressure control devices within system 10, such as pressure control valve 28, pump 24 can be designed to run at a speed that is independent of the real-time pressure within supply line 22. For example, in some implementations, pump 24 can be run in a purge condition, which can, for example, correspond to a pump rate of about 63 cc/min with a goal print rate of about 50 cc/min. In some implementations, pump 24 can be run at a high print rate condition, which can, for example, correspond to a pump rate of about 21 cc/min and a goal print rate of about 20 cc/min. In some implementations, pump 24 can be run at a low print rate condition, which can, for example, correspond to a pump rate of about 12 cc/min and a goal print rate of about 10 cc/min. In certain implementations where pump 24 is in the form of a peristaltic pump, pump 24 can be run at a pump rate of about 14 cc/min with a goal print rate of about 10 cc/min. In certain implementations where pump 24 is in the form of a peristaltic pump, pump 24 can be run at a pump rate of about 34 cc/min with a goal print rate of about 20 cc/min.

In some implementations, pump 24 can receive feedback from sensors within system 10 so as to regulate the pump's flow rate based on the feedback. For example, system 10 can include one or more pressure sensors and pump 24 can be controlled by a controller that speeds up or slows down pump 24 based on the feedback from the sensors.

In implementations where multiple printing fluid colors are used for printing, pumps corresponding to each printing fluid line can be programmed to run at different speeds and/or provide different pump rates for the various colors. For example, at 24 RPM, a first pump for circulating black printing fluid can be designed to pump printing fluid at about 13 cc/min, a second pump for circulating yellow printing fluid can be designed to pump printing fluid at about 14 cc/min, a third pump for circulating cyan printing fluid can be designed to pump printing fluid at about 13 cc/min, and a fourth pump for circulating magenta printing fluid can be designed to pump printing fluid at about 13 cc/min.

As described above, various lines can be used to connect components of system 10 or components used with system 10. For example, reservoir line 54 can be designed to connect printing fluid reservoir 12 to air isolation chamber 16, supply line 22 can be designed to supply printing fluid 14 from air isolation chamber 16 to printhead assembly 18, and return line 26 can be designed to return unejected printing fluid 14 from printhead assembly 18 to air isolation chamber 16. These lines can, for example, be in the form of a rigid or flexible tubing or another suitable structure. Such flexible structures can be designed to allow a first component of system 10 (e.g., a printhead assembly for a scanning-type printhead system) to move relative to another component of system 10 (e.g., a fixed air isolation chamber) during printing. One or more of these lines can include a valve or other device to restrict, divert, or otherwise control flow within the line.

One or more of these lines can, for example, be an extension of a component (e.g., an extension of printing fluid reservoir 12, air isolation chamber 16, or printhead assembly 18) that is fluidly connected to another component. For example, as shown in FIG. 1, reservoir line 54 is an extension of printing fluid reservoir 12 that is fluidly coupled to air isolation chamber 16. One or more of these lines can, for example, be a separate piece that is fluidly connected to two component of system 10. For example, as depicted in FIG. 1, supply line 22 can be in the form of tubing that is fluidly connected at a first end to air isolation chamber 16 and fluidly connected at a second end to printhead assembly 18. Similarly, as depicted in FIG. 1, return line 26 can be in the form of tubing that is fluidly connected at a first end to air isolation chamber 16 and fluidly connected at a second end to printhead assembly 18.

As described above, system 10 can include a pressure control valve 28 along return line 26 to regulate the return flow of unejected printing fluid 14 to air isolation chamber 16 based on the pressure within return line 26. Pressure control valve 28 can, for example, be in the form of a seated ball valve that includes a spring biased to close a path to air isolation chamber 16 when the pressure within return line 26 is below a predetermined value and to open a path to air isolation chamber 16 when the pressure within return line 26 is above or equal to the predetermined value.

In some implementations, pressure control valve 28 is in the form of a duckbill valve that is biased to close a path to air isolation chamber 16 when the pressure within return line 26 is below a predetermined value and to open a path to air isolation chamber 16 when the pressure within return line 26 is above or equal to the predetermined value.

Pressure control valve 28 is positioned along return line 26 such that printing fluid 14 is passed through pressure control valve 28 in order to pass from printhead assembly 18 to air isolation chamber 16. For example, in some implementations, such as the implementation depicted in FIG. 1, pressure control valve 28 is positioned along return line 26 by being housed within air isolation chamber 16 (or attached to an exterior of air isolation chamber 16) and connected to an end of return line 26 such that printing fluid 14 is passed through pressure control valve 28 before it can flow into air isolation chamber 16. Likewise, in some implementations, pressure control valve 28 can be housed within printhead assembly 18 (or attached to an exterior of printhead assembly 18) such that printing fluid 14 is passed through pressure control valve 28 before it enters an interior of return line 26. In some implementations, pressure control valve 28 is positioned along return line 26 by connecting a first segment of return line 26 to a second segment of return line 26 such that printing fluid 14 is passed through pressure control valve 28 in order to pass from the first segment of return line 26 to the second segment of return line 26.

Figure 2:
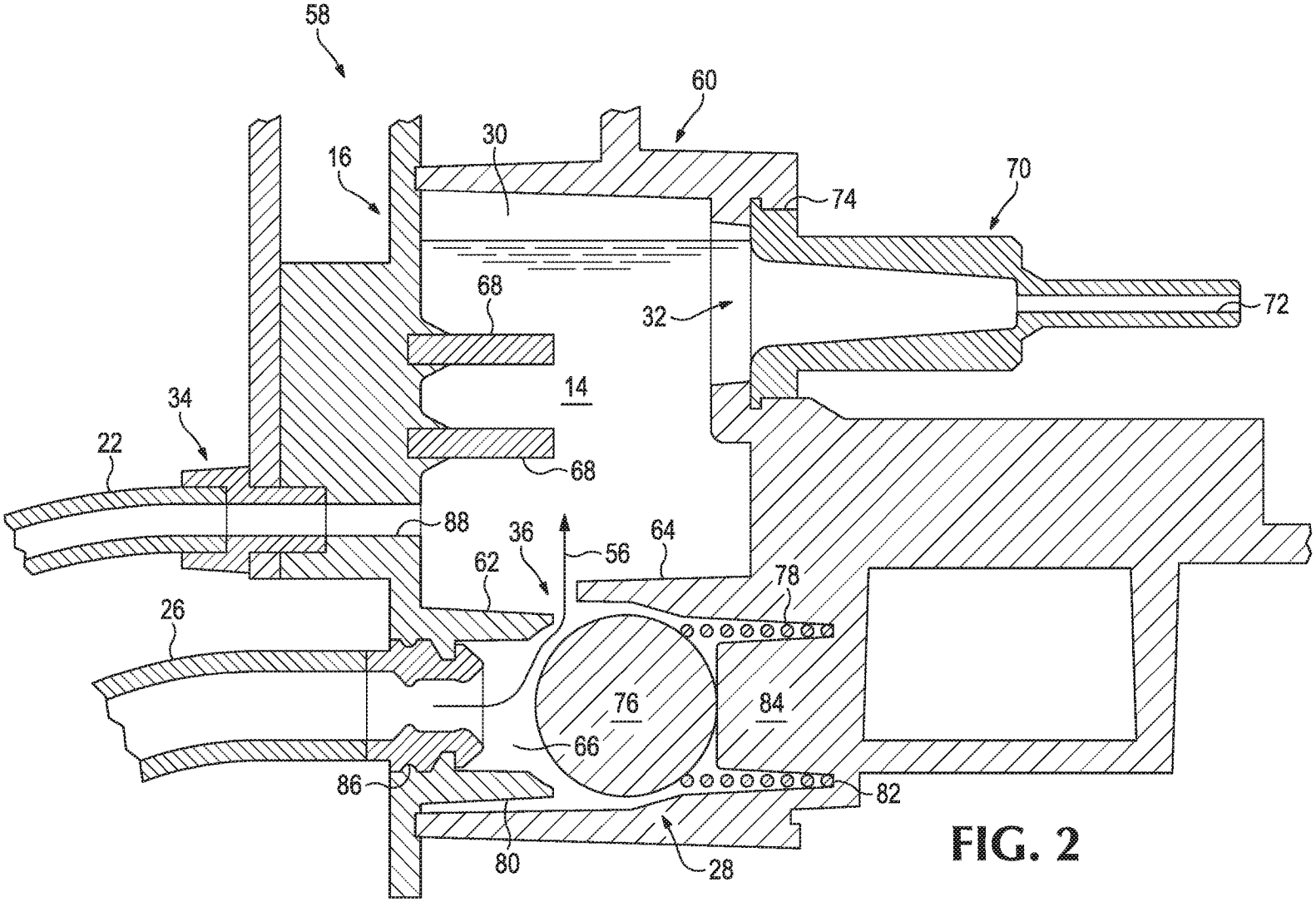
FIG. 2 illustrates a portion of a printing fluid circulation and printing system in an open configuration, according to an example.
Figure 3:
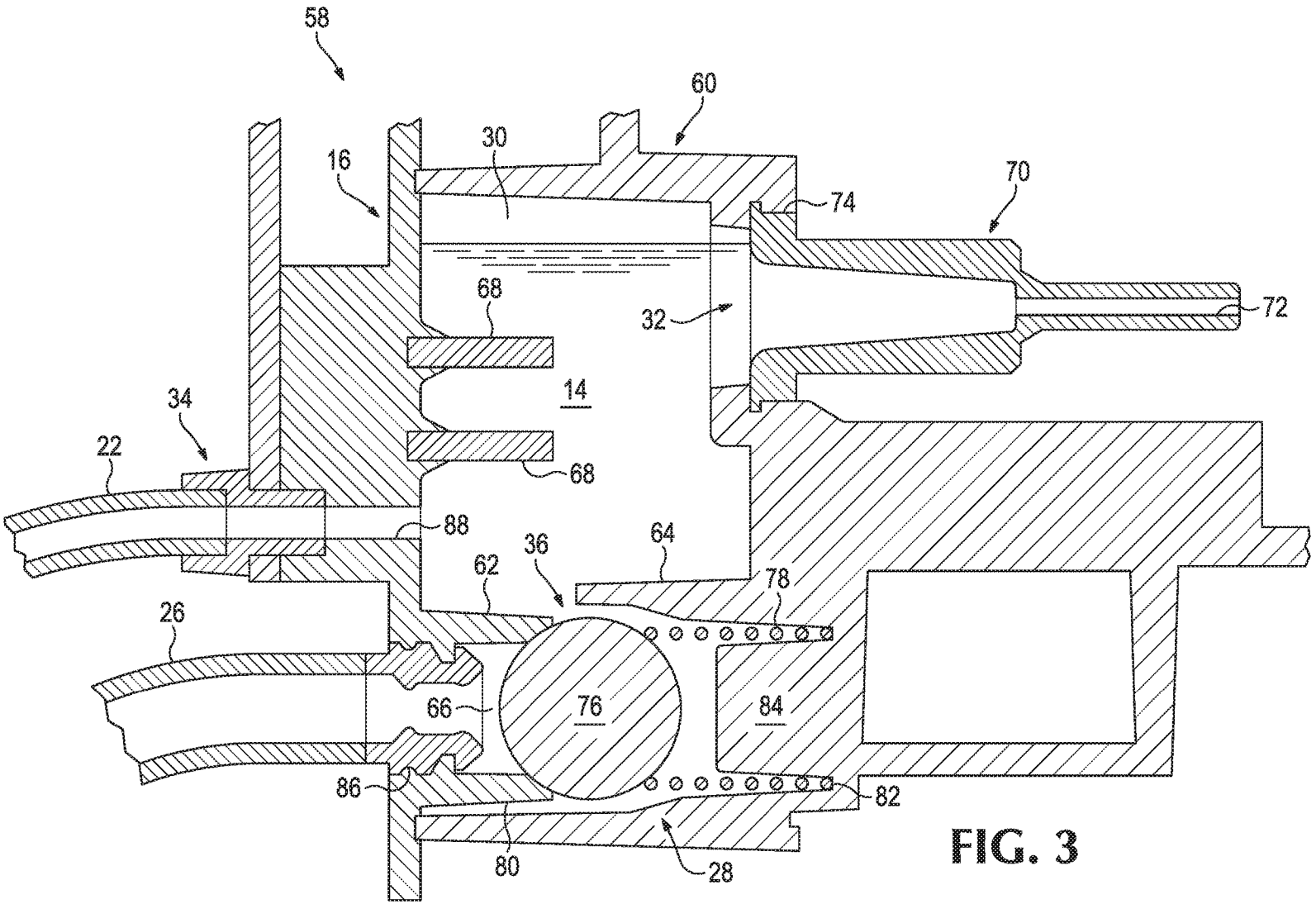
FIG. 3 illustrates a portion of a printing fluid circulation and printing system in a closed configuration, according to an example.

FIGS. 2 and 3 are cross-sectional views of a portion of a specific example implementations of a printing fluid circulation and printing system 58 including a specific implementation of pressure control valve 28 and air isolation chamber 16. In particular, FIG. 2 illustrates an example of pressure control valve 28 in an "open" state to allow printing fluid 14 to flow from return line 26 into air isolation chamber 16 along path 56 and FIG. 3 illustrates an example of pressure control valve 28 in a "closed" state to block printing fluid 14 from flowing from return line 26 into air isolation chamber 16. The description of system 58 in FIGS. 2-3 and its components make reference to elements of diagram system 10 in FIG. 1 for illustration. However, it is appreciated that one or more components or functional aspects of system 58 can be implemented in any other suitable system described herein or vice versa.

In system 58, pressure control valve 28 and air isolation chamber 16 are combined within a single housing 60 such that pressure control valve 28 and air isolation chamber 16 share common walls 62 and 64. In some implementations, pressure control valve 28 and air isolation chamber 16 can be positioned in separate housings and fluidly connected through tubing or another suitable fluid coupler. Housing 60 can be formed from a single piece of material, such as a single piece of plastic, or can be formed by attaching multiple pieces of material together. In implementations where an interior surface of air isolation chamber 16 is formed by multiple pieces of material, it is appreciated that these pieces of materials could be sealed together, or housing 60 itself could be otherwise sealed, so as to prevent printing fluid 14 from leaking out of housing 60.

In system 58, an opening between wall 62 and wall 64 serves as return inlet 36 for returning unejected printing fluid 14 from a cavity 66 of pressure control valve 28 to air isolation chamber 16. In some implementations, return inlet 36 can be fluidly connected to cavity 66 through a pathway in the form of a tube or other intermediate structural component that can be blocked off when pressure control valve 28 is closed.

In system 58, printing fluid level sensors 68 are used to measure a level of printing fluid 14 within air isolation chamber 16. These printing fluid level sensors 68 can, for example, be in the form of probes that extend into air isolation chamber 16, such as depicted in FIGS. 2-3. In some implementations, printing fluid level sensors 68 can be flush with an interior wall of air isolation chamber 16 or can be recessed within air isolation chamber 16. In some implementations, printing fluid level sensors 68 can be coupled to a processor to provide an alert to an operator when a printing fluid level in air isolation chamber 16 is below a desired level.

In system 58, an inlet needle 70 serves as reservoir line 54 for interfacing with printing fluid reservoir 12 (not shown in FIGS. 2-3). Inlet needle 70 can, for example, be in the form of a plastic extension with a lumen 72 that fluidly connects a distal opening on a distal end of the extension to a proximal opening on a proximal end of the extension. Inlet needle 70 can include a flange 74 for insertion into a corresponding opening of housing 60 to secure inlet needle 70 to housing 60. Inlet needle 70 can be designed such that lumen 72 is aligned with reservoir inlet 32 of housing 60 such that printing fluid 14 traveling from printing fluid reservoir 12 car pass through both inlet needle 70 and reservoir inlet 32 so as to be deposited within air isolation chamber 16.

In system 58, pressure control valve 28 is in the form of a seated ball valve. As pressurized printing fluid 14 flows through return line 26 and into cavity 66, a ball 76 is moved against a spring 78 to open a passage through return inlet 36. In this implementation, as shown for example in FIG. 3, ball 76 is seated on a ball seat 80 when valve 28 is in a closed position and, as shown for example in FIG. 2, a gap serving as return inlet 36 is provided between ball 76 and ball seat 80 when valve 28 is in an open position to allow printing fluid 14 to flow along path 56. An opposite end of ball 76 is seated on a first end of spring 78, with a second end of spring 78 being seated onto a spring seat 82 of housing 60 to allow spring 78 to compress as ball 76 is moved against spring 78. Housing 60 can, for example, include a stop 84 to prevent undesired compression of spring 78 by restricting ball 76 from moving beyond a desired compression distance.

In system 58, return line 26 is fluidly connected to cavity 66 of housing 60. In some implementations, return line 26 includes a gasket 86 to fluidly seal an interface between return line 26 and housing 60. During installation, gasket 86 of return line 26 can be plugged into a corresponding opening of housing 60 to secure return line 26 to housing 60. Gasket 86 can be a separate piece of material coupled to return line 26 or can be a monolithic extension of return line 26 with both return line 26 and gasket 86 being made from the same piece of material. Cavity 66 can be formed by cutting out material from housing 60 or through another suitable method depending on the material used for housing 60. For example, cavity 66 can be formed in housing 60 during an injection molding procedure, formed via photolithography, or formed by another suitable method.

In system 58, a supply outlet 34 is formed as an extension of housing 60 that can be fluidly connected to supply line 22. In some implementations, supply line 22 can include a gasket to fluidly seal an interface between supply line 22 and housing 60. During installation, the gasket can be plugged into a corresponding opening of housing 60 to secure supply line 22 to housing 60. The gasket can be a separate piece of material coupled to supply line 22 or can be a monolithic extension of supply line 22, with both supply line 22 and the gasket being made from the same piece of material.

In some implementations, housing 60 can include a channel 88 designed to allow printing fluid 14 to flow from air isolation chamber 16 to supply line 22 to be circulated through printhead assembly 18. Channel 88 can be formed by cutting out material from housing 60 or through another suitable method depending on the material of housing 60. For example, channel 88 can be formed in housing 60 during an injection molding procedure, formed via photolithography, or formed by another suitable method.

Figure 4:
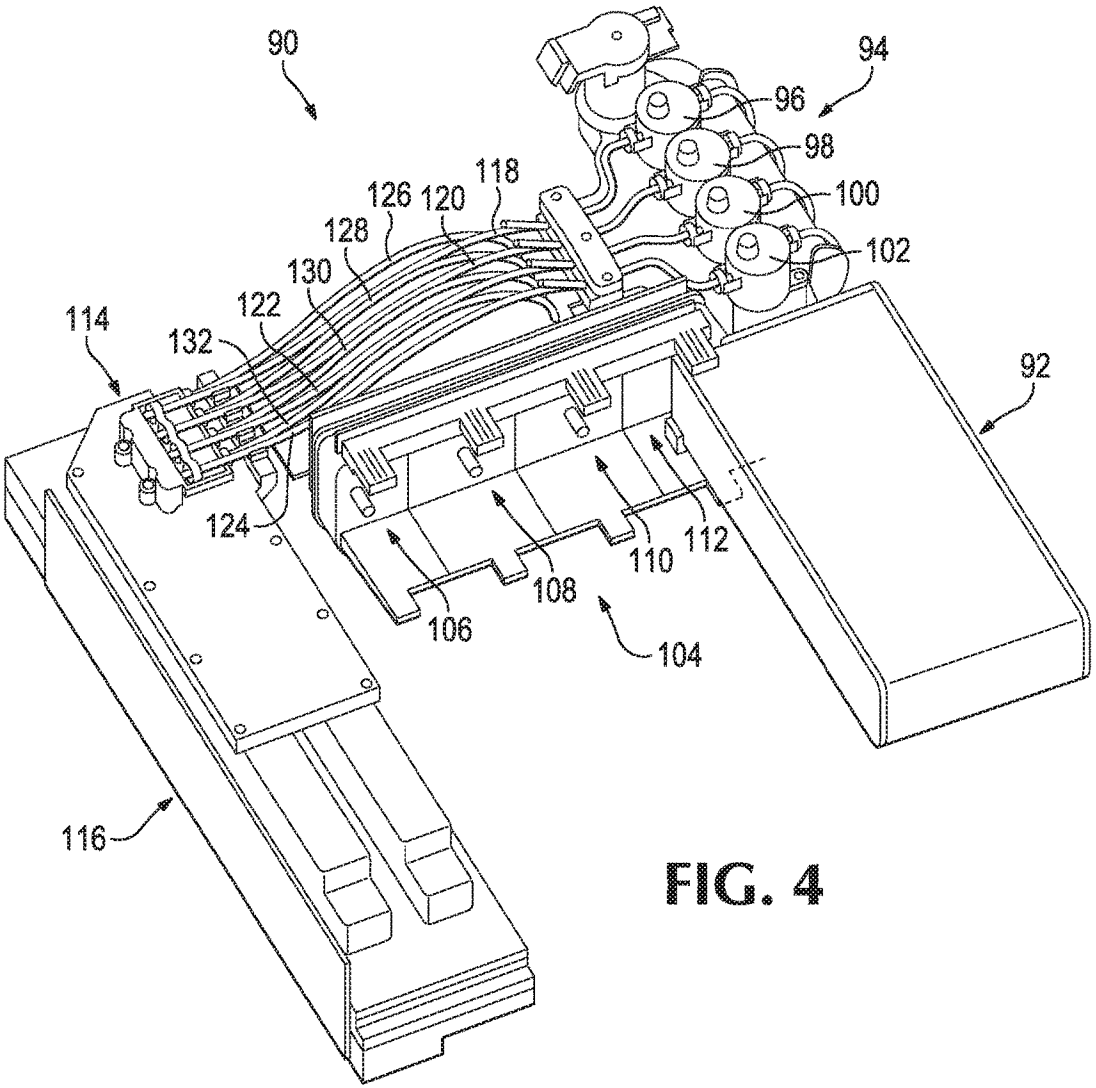
FIG. 4 illustrates a printing fluid circulation and printing system, according to an example.

FIG. 4 illustrates an example implementation of a printing fluid circulation and printing system 90. The description of system 90 in FIG. 4 and its components make reference to elements of diagram system 10 in FIG. 1 and system 58 in FIGS. 2-3 for illustration. However, it is appreciated that one or more components or functional aspects of system 90 can be implemented in another suitable system described herein or vice versa.

System 90 is designed to accommodate four separate printing fluid circuits. The four separate printing fluid circuits can, for example, correspond to circuits for different colors or types of printing fluid. For example, a first printing fluid circuit can circulate yellow printing fluid, a second printing fluid circuit can circulate cyan printing fluid, a third printing fluid circuit can circulate magenta printing fluid, and a fourth printing fluid circuit can circulate black printing fluid. However, it is appreciated that the same type and color of printing fluid can be provided in separate circuits for redundancy or other purposes. For example, each circuit can include the same type of black printing fluid.

One implementation of system 90 includes: (1) first, second, third, and fourth printing fluid reservoirs (with first printing fluid reservoir 92 being illustrated in FIG. 4 and second, third, and fourth printing fluid reservoirs being omitted so as not to obscure other components of system 90); (2) a pump unit 94 that houses first, second, third, and fourth pumps 96, 98, 100, and 102; (3) a combined air isolation chamber and pressure control valve unit 104 that houses first, second, third, and fourth combined air isolation chambers and pressure control valves 106, 108, 110, and 112; (4) a manifold 114 fluidly coupled to the various pumps of pump unit 94; (5) a print bar 116 that includes various printheads and is fluidly coupled to manifold 42; (6) supply lines 118, 120, 122, and 124 to fluidly connect respective pumps of pump unit 94 to respective supply inlets of manifold 114; (7) return lines 126, 128, 130, and 132 to fluidly connect respective return outlets of manifold 114 to respective inlets of combined air isolation chamber and pressure control valve unit 104.

The various printing fluid reservoirs within system 90 can be individually replaceable within system 90 or can be combined into a single replaceable printing fluid reservoir unit. In some implementations, the various printing fluid reservoirs can be designed to be non-removably installed within a printer. The various components of the integrated units described in system 90, such as pumps 96, 98, 100, and 102 of pump unit 94 can, in some implementations, be separated such that they do not share a common housing or support. For example, in some implementations, first pump 96 can be located on an opposite end of a printer from second pump 98 and can be housed in separate housings. It is appreciated that similar arrangements can be used for other units depicted as being combined in FIG. 4, such as for example, combined air isolation chamber and pressure control valve unit 104.

Figure 5:
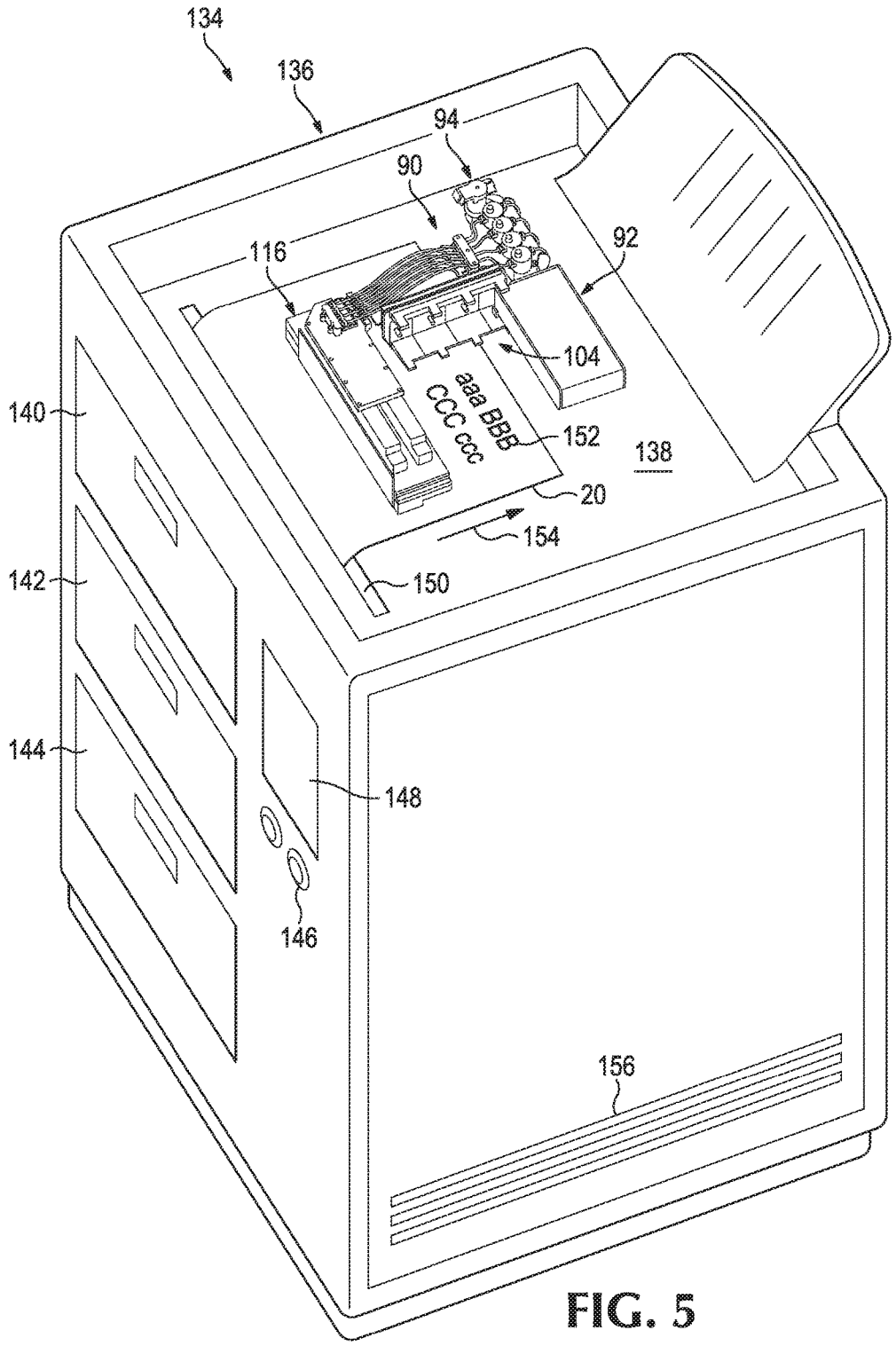
FIG. 5 illustrates a printer incorporating a printing fluid circulation and printing system, according to an example.

FIG. 5 is a diagram of an example of a printer 134 that incorporates a printing fluid circulation and printing system 90. A top cover of printer 134 is removed in FIG. 5 so as to illustrate the location of printing fluid circulation and printing system 90 within a printing cavity 138 of printer 134. The description of printer 134 in FIG. 5 and its components make reference to elements of systems 10, 58, and 90 in FIGS. 1-4 for illustration. However, it is appreciated that one or more components or functional aspects of printer 134 can be implemented in another system described herein or vice versa. Moreover, the term "printer" is used for convenience and can, for example, refer to both standalone printers or another machine capability of printing, such as an all-in-one device that provides printing and provides non-printing functionality, such as a combination printer, scanner, and fax machine.

The implementation of printer 134 depicted in FIG. 5 includes a housing 136 that houses various internal parts of printer 134, a printing cavity 138 in which printing fluid circulation and printing system 90 is located, first, second, and third media trays 140, 142, and 144 for holding a printer media 20, buttons 146 for operating printer 134, and a display screen 148 to display information regarding printer 134. These components are further described below. It is appreciated that, in some implementations, printer 134 may include additional, fewer, or alternative components. For example, in some implementations, printer 134 may not include buttons 146 or display screens 148 and may instead be remotely controlled by an external computer or controller.

In use, printer media 20 is passed through a slot 150 of printer 134 and is then positioned under print bar 116. Print bar 116 then prints text, pictures, or other graphics 152 onto media 20 by propelling droplets of liquid printing fluid onto media 20. In this implementation, print bar 116 is a fixed position print bar with a page-wide array of nozzles and is designed to allow media 20 to be moved under its nozzles. Print bar 116 can be moved for servicing, capping, or the like. In some implementations, print bar 116 can be designed to move during printing. For example, print bar 116 can be designed to move side-to-side relative to printer media 20 while printer media 20 is fixed or while printer media 20 is moved in a feed direction 154.

Housing 136 of printer 134 is designed to house various internal parts of printer 134, such as printing fluid circulation and printing system 90, a feeder module to feed printer media through printer 134, a processor for controlling operation of printer 134, a power supply for printer 134, and other internal components of printer 134. In some implementations, housing 136 can be formed from a single piece of material, such as metal or plastic sheeting. In some implementations, housing 136 can be formed by securing multiple panels or other structures to each other. For example, in some implementations, housing 136 is formed by attaching separate front, rear, top, bottom, and side panels. Housing 136 can include various openings, such as openings to allow media trays 140, 142, and 144 to be inserted into housing 136 and vents 156 to allow airflow into the interior of printer 134.

Media trays 140, 142, and 144 can be used to store printer media, such as for example printer paper. Each media tray can, for example, be designed to hold the same or a different size media. For example, media tray 140 can be designed to hold standard letter-sized paper, media tray 142 can be designed to hold A4 paper, and media tray 144 can be designed to hold 11×17 paper. It is appreciated that printing fluid circulation and printing system 90 can be used in printers with only a single media tray or, in some implementations, with no media trays.

Printer 134 can include one or more input devices to send operator inputs to printer 134. For example, as depicted in FIG. 5, such input devices can include buttons 146, which can, for example, be designed to allow an operator to cancel, resume, or scroll through print jobs. Buttons 146 can also be designed to allow an operator to view or modify printer settings. It is appreciated that in some implementations, printer 134 can be remotely controlled by a remote computer or operator and may not include buttons 146 or other user inputs.

Printer 134 can include one or more output devices to provide output information from printer 134 to an operator. For example, as depicted in FIG. 5, such an output device can be in the form of a display screen 148 connected to a processor to display information regarding printer 134, such as information regarding a current or queued print job, information regarding settings of printer 134, or other information. It is appreciated that printer 134 may include other types of output devices to convey information regarding printer 134, such as a speaker or other suitable output device.

In some implementations, display screen 148 and buttons 146 can be combined into a single input/output unit. For example, in some implementations, display screen 148 can be in the form of a single touchscreen that both accepts input and displays output. In some implementations, printer 134 does not include any input/output units and is instead connected to another device or devices for receiving input and sending output. For example, in some implementations, printer 134 can interface with a remote computer over the Internet or within an internal network. The remote computer can, for example, receive input from a keyboard or other suitable input device, and output information regarding printer 134 via a monitor or other suitable output device.

Figure 6:
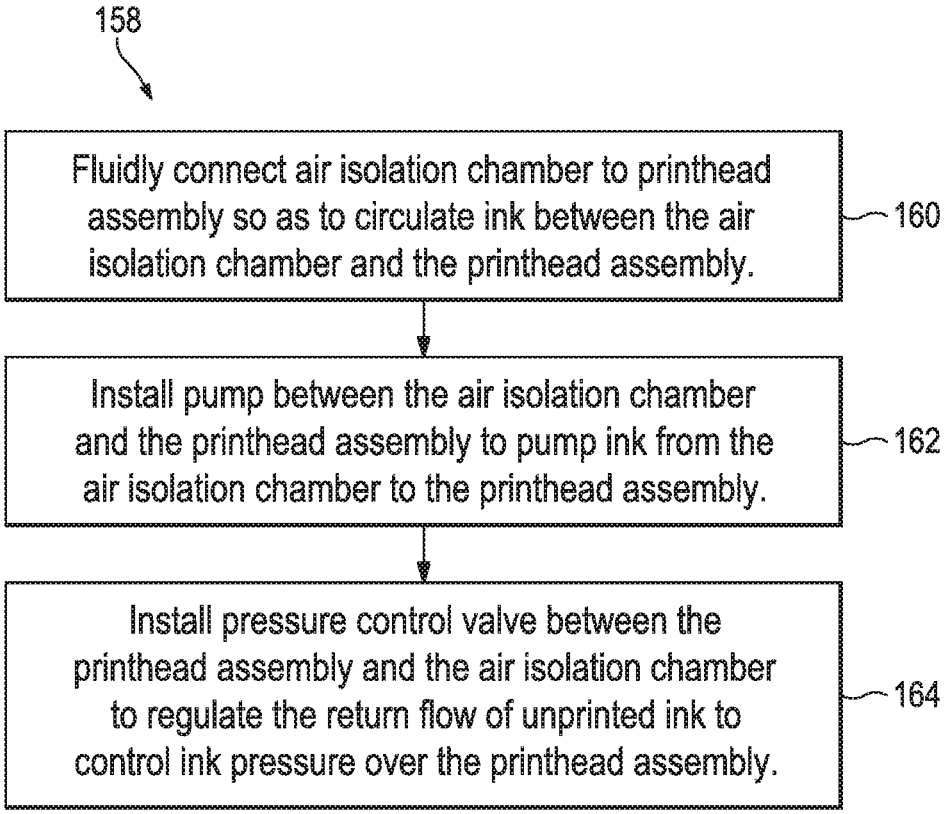
FIG. 6 is a flowchart for a method of installing a printing fluid circulation and printing system, according to an example.

FIG. 6 illustrates a flowchart for an example method 158 relating to installing a printing fluid circulation and printing system. The description of method 158 and its component steps make reference to elements of systems 10, 58, 90, and printer 134 for illustration, however, it is appreciated that this method can be used for any suitable system described herein or otherwise.

Method 158 includes a step 160 of fluidly connecting air isolation chamber 16 to printhead assembly 18 to circulate printing fluid 14 between air isolation chamber 16 and printhead assembly 18. Printhead assembly 18 can, for example, be designed to print a portion of printing fluid 14 onto printer media 20 during printing. In some implementations, step 160 can include a first sub-step of fluidly connecting a first end of supply line 22 to supply outlet 34 of air isolation chamber 16, a second sub-step of fluidly connecting a second end of supply line 22 to supply inlet 48 of printhead assembly 18, a third sub-step of fluidly connecting a first end of return line 26 to return outlet 50 of printhead assembly 18, and a fourth sub-step of fluidly connecting a second end of return line 26 to return inlet 36 of air isolation chamber 16.

Method 158 includes a step 162 of installing pump 24 between air isolation chamber 16 and printhead assembly 18 to pump printing fluid 14 from air isolation chamber 16 to printhead assembly 18. In embodiments where supply line 22 is provided between air isolation chamber 16 and printhead assembly 18, pump 24 can be installed along supply line 22 at either end of supply line 22. For example, pump 24 can be secured within system 10 by connecting an input end of pump 24 to a passage leading from air isolation chamber 16 and connecting an output end of pump 24 to supply line 22. In some implementations, pump 24 can be installed along supply line 22 by connecting a first segment of supply line 22 to an input end of pump 24 and by connecting a second segment of supply line 22 to an output end of pump 24.

Method 158 includes a step 164 of installing pressure control valve 28 between printhead assembly 18 and air isolation chamber 16 to regulate the return flow of unejected printing fluid 14 to air isolation chamber 16 to control printing fluid pressure over printhead assembly 18. In embodiments where return line 26 is provided between printhead assembly 18 and air isolation chamber 16, pressure control valve 28 can be installed along return line 26 at either end of return line 26. For example, pressure control valve 28 can be secured within system 10 by connecting an input end of pressure control valve 28 to a passage leading from printhead assembly 18 and connecting an output end of pressure control valve 28 to return line 26. In some implementations, pressure control valve 28 can be installed along return line 26 by connecting a first segment of return line 26 to an input end of pressure control valve 28 and by connecting a second segment of return line 26 to an output end of pressure control valve 28.

In some implementations, system 10 can be used to ensure that a pressure upstream of printhead assembly 18 stays within an acceptable range (e.g., from about 0 to about 300 inches of water pressure for some implementations). In such implementations, such an upstream pressure can be maintained even if printing fluid in air isolation chamber 16 goes to a pressure well below zero. In some implementations, pressure control valve 28 allows system 10 to build pressure in response to the flow from pump 24 and keeps regulator inlets for printhead assembly 18 within an acceptable range over a wide range of pump rates and print rates.

In some implementations, method 158 can include a step of fluidly connecting air isolation chamber 16 to an external printing fluid supply, such as a printing fluid reservoir 12 to receive printing fluid from the external printing fluid supply. In some implementations, this step can include inserting an inlet needle 70 extending from air isolation chamber 16 and serving as a reservoir line 54 into a corresponding opening (or pierceable seal) of printing fluid reservoir 12. In implementations where reservoir line 54 is in the form of tubing or another separate piece of material, a first end of reservoir line 54 can be plugged into reservoir inlet 32 of air isolation chamber 16 and a second end of reservoir line 54 can be plugged into an inlet of printing fluid reservoir 12.

Although the flowchart of FIG. 6 shows a specific order of performance, it is appreciated that this order may be rearranged into another suitable order, may be executed concurrently or with partial concurrence, or a combination thereof. As but one example, step 162 of installing pump 24 may be performed after or at the same time as step 164 of installing pressure control valve 28. Likewise, suitable additional and/or comparable steps may be added to method 158 to achieve the same or comparable functionality.

While certain implementations have been shown and described above, various changes in form and details may be made. For example, some features that have been described in relation to one implementation and/or process can be related to other implementations. In other words, processes, features, components, and/or properties described in relation to one implementation can be useful in other implementations. Furthermore, it should be understood that the systems, apparatuses, and methods described herein can include various combinations and/or sub-combinations of the components and/or features of the different implementations described. Thus, features described with reference to one or more implementations can be combined with other implementations described herein.

The choice of materials for the parts described herein can be informed by the requirements of mechanical properties, temperature sensitivity, moldability properties, or any other factor apparent to a person having ordinary skill in the art. For example, one more of the parts (or a portion of one of the parts) can be made from suitable plastics, metals, and/or other suitable materials.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A system comprising:

an air isolation chamber to pool and remove air bubbles within printing fluid to be circulated within the system;

a printhead assembly to print a portion of the printing fluid onto a printer media;

a supply line to supply printing fluid from the air isolation chamber to the printhead assembly;

a pump along the supply line to pump printing fluid from the air isolation chamber to the printhead assembly;

a return line to return unprinted printing fluid from the printhead assembly to the air isolation chamber; and a pressure control valve along the return line to regulate the return flow of unprinted printing fluid to the air isolation chamber to control printing fluid pressure over the printhead assembly, wherein the pressure control valve is a seated ball valve including a spring such that, during printing, the seated ball valve is to compress the spring to open a path to the air isolation chamber responsive to pressure within the return line above or equal to a predetermined value, and further such that, during printing and responsive to pressure within the return line less than the predetermined value, the seated ball valve is to seat against a common wall of the pressure control valve and the air isolation chamber to block the flow of the unprinted print fluid to the air isolation chamber.

2. The system of claim 1, wherein the printhead assembly includes:

a printhead including a nozzle to eject printing fluid towards the printer media; and a manifold that includes an inlet to receive printing fluid from the supply line, a return outlet to return unejected printing fluid to the return line, and a channel to divert a portion of the printing fluid to the printhead.

3. The system of claim 2, wherein the printhead assembly includes multiple printheads, and wherein the manifold includes multiple channels to divert printing fluid from the manifold to a corresponding printhead.

4. The system of claim 1, wherein the printhead assembly is moved relative to the air isolation chamber during printing.

5. The system of claim 4, wherein the supply line and return line are in the form of flexible tubing that moves with the printhead assembly during printing.

6. The system of claim 1, wherein the pump is to pump printing fluid from the air isolation chamber to the printhead assembly by deforming the supply line.

7. The system of claim 1, wherein the pump is in the form of a diaphragm pump that connects a first segment of the supply line to a second segment of the supply line.

8. The system of claim 1, wherein the spring is biased to close the path to the air isolation chamber when the pressure within the return line is below the predetermined value.

9. The system of claim 1, wherein the pressure control valve connects a first segment of the return line to a second segment of the return line.

10. The system of claim 1, wherein the pressure control valve is positioned at the air isolation chamber and connects an end of the return line to the air isolation chamber.

11. A method comprising:

fluidly connecting an air isolation chamber to a printhead assembly in a printing fluid circulation and printing system so as to circulate printing fluid between the air isolation chamber and the printhead assembly, the air isolation chamber to pool and remove air bubbles within the printing fluid and the printhead assembly to print a portion of printing fluid onto a printer media during printing;

installing a pump between the air isolation chamber and the printhead assembly to pump printing fluid from the air isolation chamber to the printhead assembly; and installing a pressure control valve between the printhead assembly and the air isolation chamber to regulate the return flow of unprinted printing fluid to the air isolation chamber to control printing fluid pressure over the printhead assembly, wherein the pressure control valve is a seated ball valve including a spring such that, during printing, the seated ball valve compresses the spring to open a path to the air isolation chamber responsive to pressure within the return line above or equal to a predetermined value, and further such that, during printing and responsive to pressure within the return line less than the predetermined value, the seated ball valve seats against a common wall of the pressure control valve and the air isolation chamber to block the flow of the unprinted print fluid to the air isolation chamber and produce a positive pressure in the printhead assembly.

12. The method of claim 11, wherein fluidly connecting the air isolation chamber to a printhead assembly includes:

fluidly connecting a first end of the supply line to an outlet of the air isolation chamber;

fluidly connecting a second end of the supply line to an inlet of the printhead assembly;

fluidly connecting a first end of the return line to an outlet of the printhead assembly; and fluidly connecting a second end of the return line to an inlet of the air isolation chamber.

13. A printer comprising:

a printing fluid reservoir to hold a printing fluid supply;

an air isolation chamber in fluid connection with the printing fluid reservoir to receive printing fluid from the printing fluid reservoir, the air isolation chamber to be partially filled with printing fluid so as to pool printing fluid and provide an air pocket to remove air bubbles from the printing fluid;

a printhead assembly in fluid communication with the air isolation chamber to circulate printing fluid between the air isolation chamber and the printhead assembly and to print a portion of the circulated printing fluid onto a printer media;

a supply line to supply printing fluid from the air isolation chamber to the printhead assembly;

a pump along the supply line to pump printing fluid from the air isolation chamber to the printhead assembly;

a return line to return unprinted printing fluid from the printhead assembly to the air isolation chamber; and a pressure control valve connected to the return line to regulate the flow of unprinted printing fluid to the air isolation chamber to control printing fluid pressure over the printhead assembly, wherein the pressure control valve is a seated ball valve including a spring such that, during printing, the seated ball valve is to compress the spring to open a path to the air isolation chamber responsive to pressure within the return line above or equal to a predetermined value, and further such that, during printing and responsive to pressure within the return line less than the predetermined value, the seated ball valve is to set against a common wall of the pressure control valve and the air isolation chamber to block the flow of the unprinted print fluid to the air isolation chamber and to build the printing fluid pressure over the printhead assembly.

14. The printer of claim 13, wherein the pump is to run at a speed that is independent of the real-time pressure within the supply line.

* * * * *